US005765092A

United States Patent [19]

Yoshiuchi et al.

[11] Patent Number: 5,765,092

[45] Date of Patent: Jun. 9, 1998

[54] IMAGE FORMING APPARATUS INCLUDING REGISTRATION ROLLER LOCKING DEVICE AND DRIVE CONTROL

[75] Inventors: Katsuhiro Yoshiuchi; Hiroshi Kageyama, both of Osaka, Japan

[73] Assignee: Mita Industrial Co., Ltd., Osaka, Japan

[21] Appl. No.: 686,716

[22] Filed: Jul. 26, 1996

[30] Foreign Application Priority Data

Jul. 31, 1995 [JP] Japan ..... 7-195355

[51] Int. Cl.[6] ..... G03G 15/00

[52] U.S. Cl. ..... 399/394; 399/384; 399/395; 271/242

[58] Field of Search ..... 399/392, 394, 399/388, 395, 384, 385; 271/9.09

[56] References Cited

U.S. PATENT DOCUMENTS

| | | | |
|---|---|---|---|
| 3,960,446 | 6/1976 | Ogawa et al. . | |
| 4,337,935 | 7/1982 | Sawada et al. . | |
| 4,392,740 | 7/1983 | Ito et al. | 399/21 |
| 4,436,406 | 3/1984 | Murasaki et al. | 399/392 |
| 4,740,817 | 4/1988 | Suzuki et al. | 399/392 |
| 5,296,906 | 3/1994 | Hano et al. | 399/385 |
| 5,347,349 | 9/1994 | Sato et al. | 399/392 |

FOREIGN PATENT DOCUMENTS

| | | |
|---|---|---|
| 61-81334 | 4/1986 | Japan . |
| 61-229755 | 10/1986 | Japan . |
| 62-93153 | 4/1987 | Japan . |
| 7-157147 | 6/1995 | Japan . |

*Primary Examiner*—Robert Beatty

*Attorney, Agent, or Firm*—Beveridge, DeGrandi, Weilacher & Young, LLP

[57] ABSTRACT

An image forming apparatus improved so that the leading end of a sheet can be exactly stopped in a nip position of registration rollers, and an image transferred to the sheet is not shifted. A locking device is provided in relation to the registration rollers provided in a conveying path. When the leading end of a cut sheet is inserted into the conveying path and is fed to the registration rollers, the registration rollers are brought into a state where it cannot be rotated by the locking device. Therefore, the leading end of the cut sheet fed is reliably stopped in the nip position of the registration rollers, and cannot enter the conveying path beyond this position. The conveyance of the cut sheet is thereafter resumed by the registration rollers and reaches a downstream pair of conveying rollers where the sheet is subjected to so-called secondary sheet feeding to an image forming section. At the same time, the locking device is turned off, whereby a load of the locking device is not applied to the registration rollers so that the registration rollers are freely rotated smoothly. When the trailing end of the cut sheet separates from the registration rollers, therefore, the cut sheet is not vibrated.

7 Claims, 6 Drawing Sheets

IMAGE FORMING APPARATUS INCLUDING REGISTRATION ROLLER LOCKING DEVICE AND DRIVE CONTROL

BACKGROUND OF THE INVENTION

1. Field of the Invention

The present invention relates generally to an image forming apparatus having a sheet feeding roller and a registration roller for conveying a sheet toward an image forming section, and more particularly, to an image forming apparatus capable of manually feeding a sheet from a manual sheet feeding port.

2. Description of the Related Art

An electrophotographic copying machine so adapted as to illuminate and scan an original, form an electrostatic latent image on a photoreceptor by light reflected from the original, develop the electrostatic latent image into a toner image, and fix the toner image to copy sheets by heating has been widely used. As such a copying machine, a copying machine capable of copying an original of large size, for example, A0 size in Japanese Industrial Standard (JIS) (hereinafter referred to as "A0 size") has been provided.

In the copying machine capable of copying an original of large size, a rolled-sheet has been generally used as copy sheets. The reason for this is that if cut sheets of predetermined size are used, a very large-sized sheet feeding cassette must be produced because the size of the cut sheets is large, whereby a main body of the copying machine and its accessories are increased in size, which is not preferable.

Examples of a copying machine capable of copying an original of large size using a rolled-sheet as copy sheets include one having a manual sheet feeding port in order to also make copies on a cut sheet. In a copying machine provided with such a manual sheet feeding port, a cut sheet is manually inserted from the manual sheet feeding port, to make copies of the original on the cut sheet.

The copying machine comprising the manual sheet feeding port has a dedicated conveying path for conveying the cut sheet inserted from the manual sheet feeding port, a so-called bypass conveying path. In the bypass conveying path, dedicated registration rollers are arranged. The conveyance of the cut sheet inserted from the manual sheet feeding port is stopped once by the registration rollers, while being resumed at predetermined timing conforming to timing of image formation on a photoreceptor.

In this case, in order that the position of the leading end of the cut sheet whose conveyance is resumed and the position of the leading end of an image formed on the photoreceptor coincide with each other, the leading end of the cut sheet must be exactly aligned with a nip position of the registration rollers immediately before the conveyance is resumed. In other words, the leading end of the cut sheet inserted from the manual sheet feeding port must be exactly stopped once along the nip position of the registration rollers.

Examples of the cut sheet of large size include so-called tough sheets, for example, a thick film sheet and thick tracing paper. When such a tough cut sheet is inserted from the manual sheet feeding port, a force in the direction of sheet insertion may, in some cases, be exerted by an operator, on a rear portion of the cut sheet extending outward from the manual sheet feeding port even after the leading end of the cut sheet has reached the nip position of the registration rollers. In such a case, the leading end of the cut sheet may, in some cases, push the registration rollers, to rotate the registration rollers so that the cut sheet enters the bypass conveying path forward beyond the nip position.

In some conventional apparatuses, a pad or the like is adapted to press against a part of a peripheral surface of one of the registration rollers to always apply a load to the registration rollers in order to solve such a problem. When the registration rollers are in a released state (a state where no driving force is exerted), therefore, the registration rollers are not easily rotated. Accordingly, it can be difficult for the tough sheet or the like to enter the bypass conveying path beyond the nip position of the registration rollers.

Where the load is always applied to one of the registration rollers, however, the following other problem occurs.

Specifically, when the conveyance of the cut sheet is resumed by the registration rollers, and the leading end of the cut sheet starts to be conveyed by succeeding conveying rollers provided on the downstream side of the conveying path, the supply of a driving force to the registration rollers is stopped. At this time, the registration rollers enter a state where it is driven by the cut sheet. In this state, when the load is always applied to the registration rollers, the load on the registration rollers is applied to the cut sheet, whereby the cut sheet is conveyed against the load applied from the registration rollers. At the moment the trailing end of the cut sheet departs from the registration rollers, the load applied to the cut sheet is suddenly removed. Since the leading end of the cut sheet has already reached the photosensitive drum and an image has already been started to be transferred to the cut sheet, the change in the load occurring in the cut sheet may cause the shift in the image transferred on the cut sheet.

Consequently, in the conventional apparatus adapted so as to always apply a load to the registration rollers, the leading end of the cut sheet inserted from the manual sheet feeding part can be stopped in the nip position of the registration rollers. At the time of transferring the image to the cut sheet, however, there occurs a new problem that an image transferred to the cut sheet is shifted.

SUMMARY OF THE INVENTION

An object of the present invention is to overcome the disadvantages of the conventional technique.

More specifically, an object of the present invention is to provide an image forming apparatus improved so that the leading end of a sheet can be exactly stopped in a nip position of a registration roller, and an image transferred to the sheet is not shifted after the conveyance of the sheet is resumed by the registration roller.

Another object of the present invention is to provide a sheet conveying method in which the leading end of a sheet can be exactly stopped at a registration roller, and the sheet can be thereafter satisfactorily conveyed.

An image forming apparatus according to the present invention comprises a sheet feeding roller arranged in a conveying path on which a sheet is conveyed toward an image forming section, and a registration roller for stopping the conveyance of the sheet once and then resuming the conveyance of the sheet. The registration roller is arranged in a position on the downstream side of the sheet feeding roller with respect to a direction of sheet conveyance in the conveying path. The image forming apparatus further comprises locking means for inhibiting the rotation of the registration roller when the leading end of the sheet is being conveyed to the registration roller by the sheet feeding roller, and releasing the inhibition of the rotation in synchronization with the resumption of the conveyance of the sheet by the registration roller.

According to the present invention, the registration roller is inhibited from being freely rotated by the locking means when it must not be rotated. Specifically, when the leading end of the sheet is conveyed to the registration roller, the rotation of the registration roller is inhibited by the locking means. Accordingly, the leading end of the sheet is stopped along a nip position of the registration roller. Even if a force in the direction of insertion is applied to the sheet, the sheet does not enter the conveying path beyond the nip position.

When the conveyance of the sheet is resumed by the registration roller, the inhibition of the rotation of the registration roller by the locking means is simultaneously released. Therefore, the registration roller conveys the sheet upon application of a driving force, while being freely rotated as the sheet is conveyed when no driving force is applied. Accordingly, the sheet is not vibrated when the trailing end of the sheet separates from the registration roller, whereby an image formed on the sheet is not shifted.

Consequently, the leading end of the sheet in the registration roller can be properly positioned, whereby an image can be formed in a desirable position on the sheet.

The image forming apparatus according to the embodiment of the present invention further comprises a conveying roller arranged in a position on the downstream side of the registration roller in the direction of sheet conveyance in the conveying path. The driving of the registration roller is stopped when the leading end of the sheet has reached the conveying roller, whereby the registration roller is brought into a freely rotatable state. Consequently, the registration roller is thereafter driven by the sheet which is conveyed by the conveying roller. In this case, a heavy load on the registration roller is not applied to the sheet. Even at the moment when the trailing end of the sheet separates from the nip position of the registration roller, therefore, a load applied to the sheet is not greatly changed. Consequently, an image formed on the sheet is not shifted.

The image forming apparatus according to the embodiment of the present invention further comprises a manual sheet feeding port for manually feeding a cut sheet of predetermined size which is connected to the conveying path. In this case, the sheet feeding roller may be one provided near the manual sheet feeding port in the conveying path for feeding the cut sheet inserted from the manual sheet feeding port toward the downstream side with respect to the direction of sheet conveyance in the conveying path.

For example, when the cut sheet of large size is inserted from the manual sheet feeding port to form an image, an operator may, in some cases, apply a force to the trailing end of the cut sheet even after the leading end of the cut sheet has reached the registration roller. Even in such a case, the rotation of the registration roller is inhibited by the locking means, whereby the leading end of the sheet can be reliably stopped in a predetermined position. Consequently, an image can be reliably formed in a desirable position on the sheet.

The locking means may be one comprising a first gear fixed to a core shaft of the registration roller, a second gear meshed with the first gear, a supporting shaft rotatably supporting the second gear and fixed to a main body frame of the image forming apparatus, and a clutch which can be switched between a fixed state where the second gear is fixed to the supporting shaft and a rotation allowable state where the rotation of the second gear around the supporting shaft is allowed.

In a sheet conveying method according to the present invention, a sheet is conveyed toward a registration roller by a sheet feeding roller, while the rotation of the registration roller is inhibited by locking means. The inhibition of the rotation of the registration roller by the locking means is released at predetermined timing after the leading end of the sheet has reached the registration roller, and the driving of the rotation of the registration roller is started to resume the conveyance of the sheet.

Consequently, the sheet can be reliably stopped in a predetermined position. Moreover, a load applied to the sheet is not greatly changed after the resumption of the conveyance of the sheet by the registration roller. Therefore, a good image can be formed on the sheet.

The driving of the registration roller may be stopped when the leading end of the sheet reaches the conveying roller arranged on the downstream side of the registration roller with respect to a direction of sheet conveyance in the conveying path, to bring the registration roller into a freely rotatable state.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
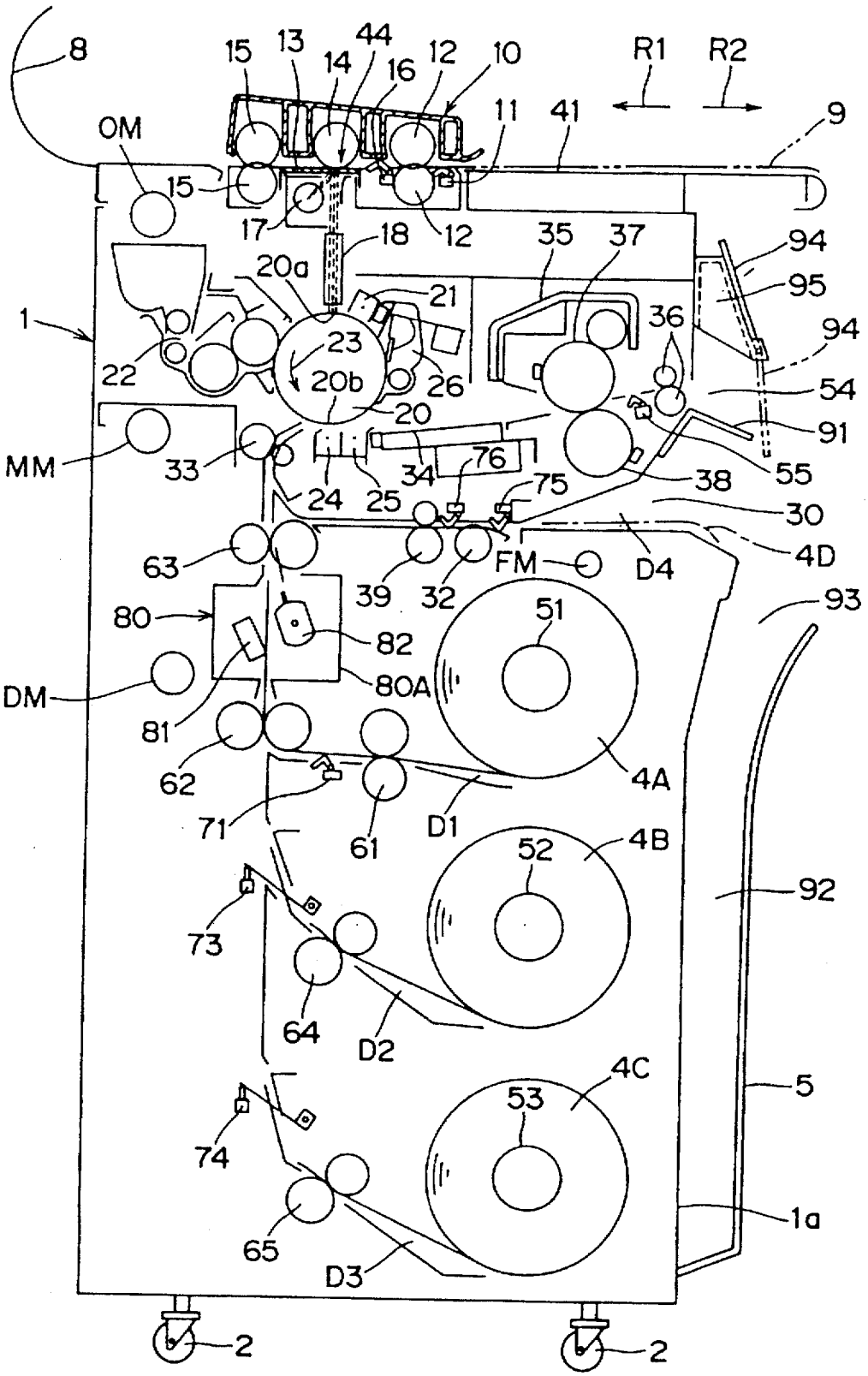
FIG. 1 is a cross-sectional view schematically showing the internal construction of a copying machine according to one embodiment of an image forming apparatus of the present invention.
Figure 2:
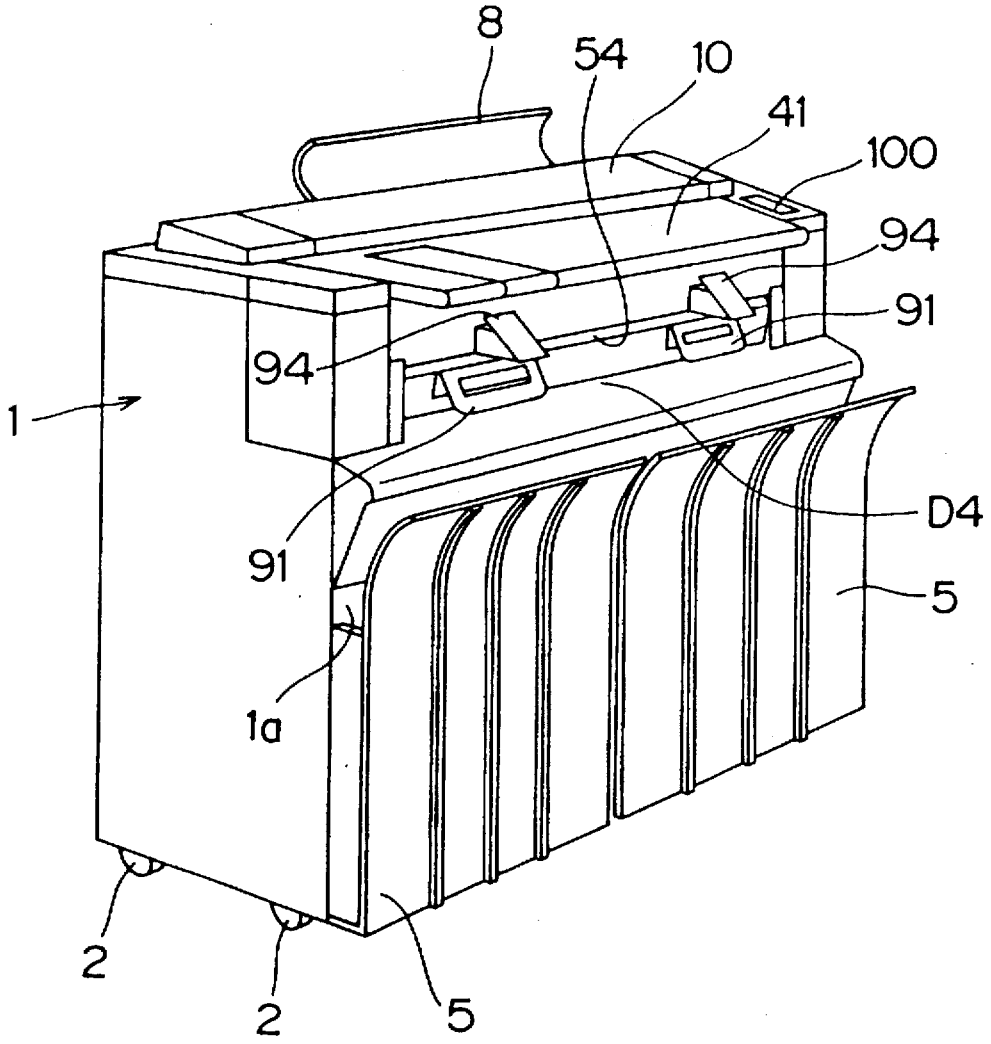
FIG. 2 is a perspective view showing the appearance of the copying machine shown in FIG. 1.
Figure 3:
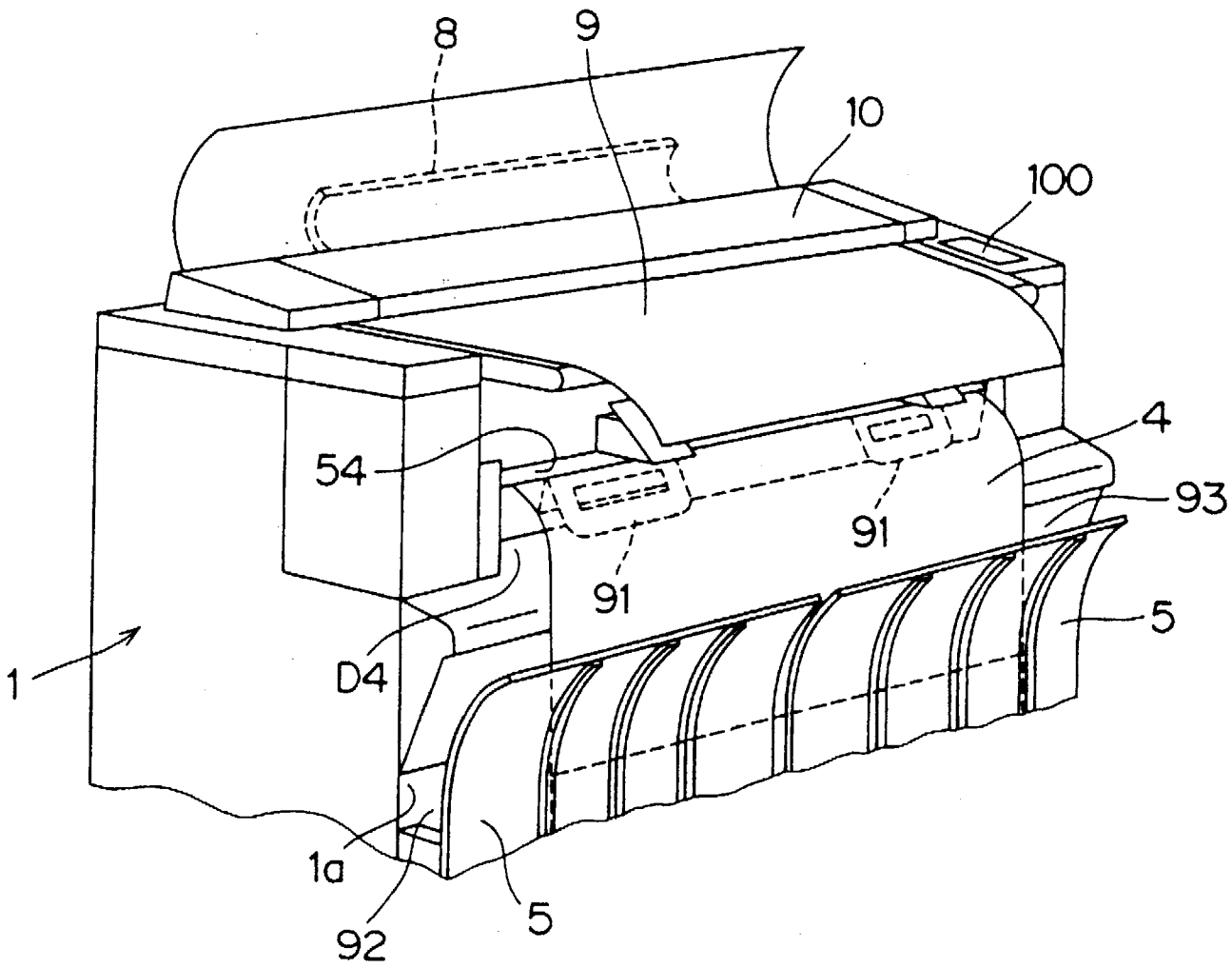
FIG. 3 is a perspective view showing the appearance at the time of copying of the copying machine shown in FIG. 1.

Fig. 1 is a cross-sectional view schematically showing the internal construction of a copying machine according to one embodiment of an image forming apparatus in the present invention, FIG. 2 is a perspective view showing the appearance of the copying machine, and FIG. 3 is a perspective view showing the appearance at the time of copying of the copying machine. The copying machine is for obtaining a copy image of an original of large size such as A0 size. In the copying machine, the original is conveyed, while an original surface is illuminated and scanned by an optical system fixedly arranged, whereby an image is formed on the basis of the illumination and scanning.

Referring to FIG. 1, a main body 1 of the copying machine has caster wheels 2 provided on its bottom, which is made movable. Referring to FIGS. 1 to 3, an original conveying section 10 for conveying an original 9 along an original conveying path 41 formed on the upper surface of the main body 1 of the copying machine is provided on the top of the main body 1 of the copying machine. A discharge port 54 for discharging a sheet to which a toner image has been transferred is opened on a front surface 1*a* of the main body 1 of the copying machine. The sheets discharged from the discharge port 54 are dropped with the leading ends directed downward while being guided by guiding members 91 as shown in FIG. 3, and the dropped sheets are successively contained in a pocket 92 formed by a front cover 5 along the front surface 1*a* of the main body 1 of the copying machine through an inlet opening 93. An operation section 100 having switches, keys, and the like for performing various setting related to copying arranged therein is provided in an end on the upper surface of the main body 1 of the copying machine.

Referring to FIG. 1, rolled-sheets 4A, 4B, and 4C in three stages, i.e., upper, intermediate and lower stages, which are wound in a roll shape are contained in a portion below the center along the height of the main body 1 of the copying machine. The rolled-sheets 4A, 4B, and 4C are respectively wound around feeding reels 51, 52, and 53. Examples of the rolled-sheets 4A, 4B, and 4C include plain paper, film, and tracing paper. A bypass conveying path D4 for feeding a cut sheet having a predetermined length such as a cut sheet of A0 size to A4 size through a manual sheet feeding section 30 on the front surface 1*a* of the main body 1 of the copying machine is provided in the center of the main body 1 of the copying machine.

The rolled-sheet 4A in the upper stage is conveyed along a first conveying path D1 leading to a photosensitive drum 20 successively through the feeding reel 51, sheet feeding rollers 61, a first leading end detecting switch 71 for detecting the leading end of the rolled-sheet 4A conveyed, conveying rollers 62, a cutter mechanism 80, conveying rollers 63, and conveying rollers 33.

The rolled-sheet body 4B in the intermediate stage is conveyed along a second conveying path D2 leading to the photosensitive drum 20 successively through the feeding reel 52, sheet feeding rollers 64, a third leading end detecting switch 73 for detecting the leading end of the rolled-sheet 4B conveyed, the conveying rollers 62, the cutter mechanism 80, the conveying rollers 63, and the conveying rollers 33. A path succeeding the conveying rollers 62 is common to the first conveying path D1.

The rolled-sheet 4C in the lower stage is conveyed along a third conveying path D3 leading to the photosensitive drum 20 successively through the feeding reel 53, sheet feeding rollers 65, a fourth leading end detecting switch 74 for detecting the leading end of the rolled-sheet 4C conveyed, the conveying rollers 62, the cutter mechanism 80, the conveying rollers 63, and the conveying rollers 33. A path succeeding the conveying rollers 62 is common to the first conveying path D1.

The above-mentioned bypass conveying path D4 is a path for leading to the photosensitive drum 20 a cut sheet 4D introduced from the manual sheet feeding section 30 successively through a fifth leading end detecting switch 75 for detecting the leading end of the cut sheet conveyed, a sheet feeding roller 32 for feeding cut sheets while separating the cut sheets (separating one at a time) by sliding contact of a friction plate (not shown), a sixth leading end detecting switch 76 for detecting the leading end of the cut sheet conveyed, registration rollers 39, and the conveying rollers 33. A path succeeding the conveying rollers 33 in the bypass conveying path D4 is common to the first conveying path D1.

The above-mentioned cuter mechanism 80 comprises a longitudinal fixed blade 81 extending in a direction perpendicularly intersecting the direction of conveyance of the rolled-sheets 4A to 4C and a rotating blade 82 for cutting the rolled-sheets 4A to 4C between the fixed blade 81 and the rotating blade 82.

The above-mentioned original conveying section 10 is for switching the direction of conveyance between a forward direction R1 and a reverse direction R2 to convey the original 9. An image forming operation is performed when the original is conveyed in the forward direction R1. When a plurality of copies are made from the same original, the original conveying section 10 alternatively switches the direction of conveyance to the forward direction R1 and the reverse direction R2, to convey the original 9. The above-mentioned original conveying path 41 is formed on the upper surface of the main body 1 of the copying machine, extending to a position where it projects from the upper surface of the main body 1 of the copying machine on the upstream side of the original conveying section 10 with respect to the forward direction R1.

The original conveying section 10 is constructed by successively arranging a first original end detecting switch 11, first conveying rollers 12, a second original end detecting switch 16, a second conveying roller 14, and third conveying rollers 15 along the forward direction R1.

The first conveying rollers 12 start to be driven upon switching of the first original end detecting switch 11 from its off state to its on state to detect the leading end of the original 9 (an end on the downstream side in the forward direction R1). The second conveying roller 14 is provided in a position opposed to a transparent plate 13 in order to subject the original 9 to slit exposure, to bring the original 9 into contact with the transparent plate 13. The third conveying rollers 15 discharges the original 9 after being exposed.

The second original end detecting switch 16 is switched from its off state to its on state when the original 9 is conveyed in the forward direction R1, to detect the leading end of the original 9. The conveyance of the rolled-sheet 4A, 4B or 4C (the rolled sheets 4A, 4B or 4C conveyed for copying are hereinafter merely referred to a "rolled-sheet 4") is started in response to that the second original end detecting switch 16 is turned on. As a result, the conveyance of the original 9 and the conveyance of the rolled-sheet 4 are synchronized with each other.

The first original end detecting switch 11 is switched from its on state to its off state when the original 9 is conveyed in the forward direction R1, to detect the trailing end of the original 9. The cutter mechanism 80 is driven at predetermined timing after an elapse of predetermined time from the timing of the detection, so that the rolled-sheet 4 is cut. In the present embodiment, the length of a conveying path of the rolled-sheet 4 from the cutter mechanism 80 to a transferring corona discharger 24 (a position for transfer 20*b*) is set to a larger length than the length of an original conveying path from the first original end detecting switch 11 to a position for original exposure 44 by a peripheral length from a position for exposure 20*a* of the photosensitive drum 20 to the position for transfer 20*b*. Consequently, an image corresponding to the trailing end of the original 9 can be formed at the trailing end of a sheet 4 obtained by cutting the rolled-sheet 4 at the above-mentioned timing.

The second original end detecting switch 16 is switched from its on state or its off state when the original 9 is conveyed in the reverse direction R2, to detect the leading end of the original 9 (the trailing end of the original in the reverse direction R2). The leading end detecting switch 16 is turned off, thereby stopping the driving of the conveying rollers 12, 14 and 15. At this time, the original 9 is readily available for the subsequent copying operation with the leading end thereof held by the conveying rollers. Reference numeral 8 denotes a reversing member for reversing the direction of the original to prevent the original 9 from dropping into the back of the main body 1 of the copying machine.

A light source 17 for illuminating the original surface of the original 9 is fixedly arranged in relation to the transparent plate 13. Light from the light source 17 is irradiated onto the surface of the original 9 through the transparent plate 13. Light reflected from the surface of the original 9 is directed to the surface of the photosensitive drum 20 provided inside the main body 1 of the copying machine through a Selfoc lens 18. The surface of the photosensitive drum 20 before being exposed by the light from the Selfoc lens 18 is uniformly charged by a charging corona discharger 21. Therefore, an electrostatic latent image corresponding to an original image is formed on the surface of the photosensitive drum 20 after being exposed. The electrostatic latent image is developed into a toner image by a developing device 22. The toner image is led to the vicinity of the transferring corona discharger 24 by the rotation of the photosensitive drum 20 in a direction indicated by an arrow 23.

On the other hand, the sheet 4 obtained by cutting the rolled-sheet 4 led to the photosensitive drum 20 through the conveying path D1, D2, D3 or D4 is further led to the vicinity of the transferring corona discharger 24 and brought into in contact with the surface of the photosensitive drum 20. The toner image on the surface of the photosensitive drum 20 is transferred to the sheet 4 by corona discharges in the transferring corona discharger 24. The sheet 4 to which the toner image has been transferred is separated from the surface of the photosensitive drum 20 by corona discharges in a separating corona discharger 25, and is further led to a fixing device 35 through a conveying path 34. In the fixing device 35, the sheet 4 is pressed and heated between a heat roller 37 and a pressure roller 38, whereby toner particles are fixed to the surface of the sheet 4. The sheet 4 to which the toner particles have been fixed is discharged to the outside of the main body 1 of the copying machine by discharge rollers 36 through a discharge detecting switch 55, and is contained in the pocket 92 through the guiding members 91 as described above. On the other hand, the toner particles remaining on the surface of the photosensitive drum 20 after transferring the toner image are removed by a cleaning device 26, to prepare for formation of the subsequent electrostatic latent image.

Guide assisting plates 94 are arranged above the above-mentioned guiding members 91. The guide assisting plates 94 are rotatably supported on stays 95 mounted on the front surface 1*a* of the main body 1 of the copying machine. The guide assisting plates 94 are rotatably displaceable between a guiding position where they hang down ahead of the guiding members 91 to guide, in cooperation with the guiding members 91, the discharged sheet to the pocket 92 (indicated by a two-dot and dash line in FIG. 1) and a containing position where they are held on the stays 95 (indicated by a solid line in FIG. 1).

The photosensitive drum 20, the developing device 22, the transferring corona discharger 24, and the like constitute image forming means. In the present embodiment, there are provided a main motor MM for driving the image forming means, a sheet feeding motor DM for driving a group of rollers for feeding the respective sheets 4A to 4D, a fixing motor FM for driving the heat roller 37 and the pressure roller 38 in the fixing device 35, and an original feeding motor OM for driving the original conveying section 10.

Figure 4:
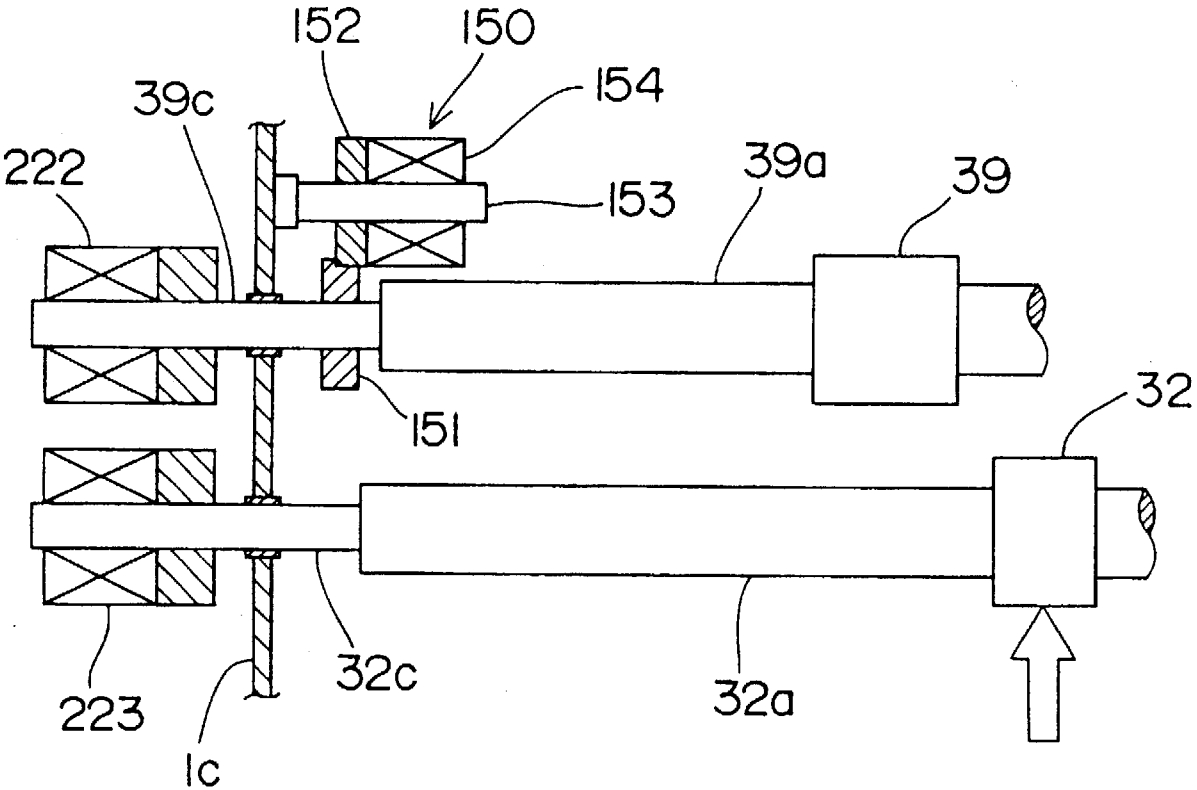
FIG. 4 is a plan view showing a specific example of the structures of a sheet feeding roller and a registration roller provided in a bypass conveying path in the copying machine shown in FIG. 1.

FIG. 4 is a partially plan view showing the characteristic features of the construction of the sheet feeding roller 32 and the registration rollers 39 which are provided in the bypass conveying path D4 for conveying a cut sheet inserted from the manual sheet feeding port 30. The sheet feeding roller 32 is externally fitted to a roller shaft 32*a* extending in a direction perpendicular to a direction of conveyance of the cut sheet indicated by a hollow white arrow. A plurality of sheet feeding rollers 32 are externally fitted at predetermined spacing to the longitudinal roller shaft 32*a*. However, only one of the sheet feeding rollers 32 is illustrated in FIG. 4, and a portion extending rightward of the roller shaft 32*a* is omitted.

A core shaft 32*c* is projected from an end of the roller shaft 32*a*. The core shaft 32*c* is rotatably held in a main body frame 1*c*. A clutch 223 is mounted on the core shaft 32*c*. The clutch 223 is turned on, for example, to transmit a driving force from the sheet feeding motor DM outside the drawing (see FIG. 1) to the core shaft 32*c*, to rotate the sheet feeding roller 32. On the contrary, the clutch 223 is turned off, to disconnect a driving force from the sheet feeding motor DM to bring the sheet feeding roller 32 into a freely rotatable state.

The registration rollers 39 are provided on the downstream side of the sheet feeding roller 32 in the direction of conveyance of the cut sheet. One of the registration rollers 39, the one on the underside of the bypass conveying path D4, is externally fitted to a roller shaft 39*a* extending in a direction perpendicular to the direction of conveyance of the cut sheet indicated by the hollow white arrow. Although a plurality of registration rollers 39 are also externally fitted at predetermined spacing to the longitudinal roller shaft 39*a*, a portion on the right side of the shown registration roller 39 is omitted in FIG. 4.

A core shaft 39*c* extends from a left end of the roller shaft 39*a*. The core shaft 39*c* penetrates the main body frame 1*c*, and is rotatably supported on the main body frame 1*c*. A clutch 222 is mounted on a left end of the core shaft 39*c*. The clutch 222 selectively transmits a driving force from the sheet feeding motor DM outside the drawing to the roller shaft 39*a* and the registration rollers 39 through the core shaft 39*c*. Specifically, if the clutch 222 is turned on, for example, the driving force from the sheet feeding motor DM outside the drawing is transmitted to the core shaft 39*c*, whereby the registration rollers 39 is rotated. On the contrary, when the clutch 222 is turned off, torque is not transmitted to the core shaft 39*c*, whereby the registration rollers 39 enters a freely rotatable state.

The present embodiment is characterized in that the registration rollers 39 is provided with a locking device 150 as described below. That is, the locking device 150 comprises a gear 151 fixed to the core shaft 39*c* and a gear 152 meshed with the gear 151. The gear 152 is rotatably mounted on a supporting shaft 153 which is fixedly studded in the main body frame 1*c*. A locking clutch 154 is connected to the gear 152. The locking clutch 154 is turned on, for example, to enter a fixed state where the gear 152 does not rotate around the supporting shaft 153. If the gear 152 cannot rotate, the gear 151 which is meshed with the gear 152 cannot rotate either, whereby the core shaft 39*c* to which the gear 151 is fixed enters a state where it cannot rotate.

On the other hand, in a state where the locking clutch 154 is turned off, the gear 152 freely rotates around the supporting shaft 153. Consequently, the gear 151 which is meshed with the gear 152 can freely rotate, whereby the existence of the locking device 150 does not substantially affect the rotation of the core shaft 39*c*.

In such construction, the locking clutch 154 included in the locking device 150 is turned on, whereby the rotation of the core shaft 39*c*, that is, the rotation of the registration roller 39 can be inhibited. If the locking clutch 154 is turned off, the registration rollers 39 enter a freely rotatable state. In other words, in a state where the locking clutch 154 is turned off, the locking device 150 does not apply a load to the registration rollers 39.

Figure 5:
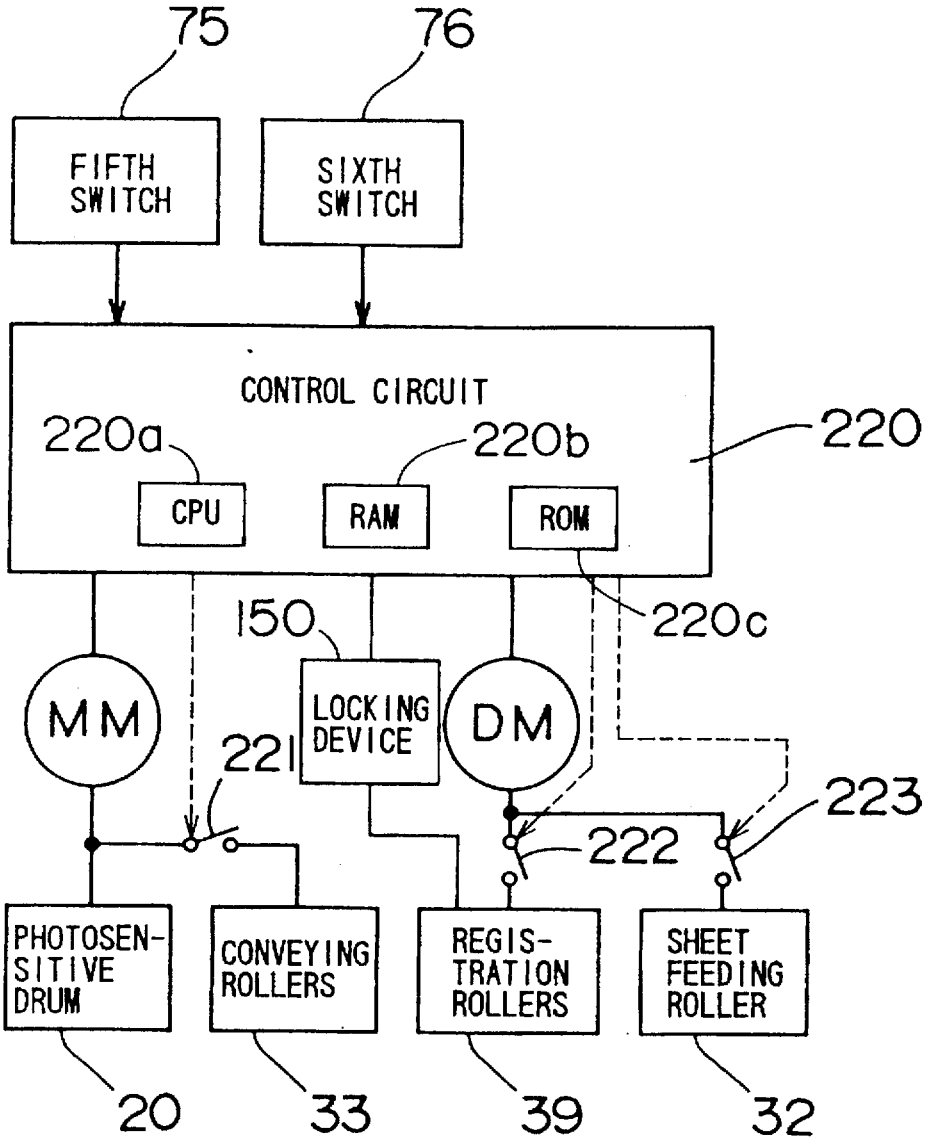
FIG. 5 is a block diagram showing the construction of a control circuit of a conveying path for conveying a cut sheet in the copying machine shown in FIG. 1.
Figure 6:
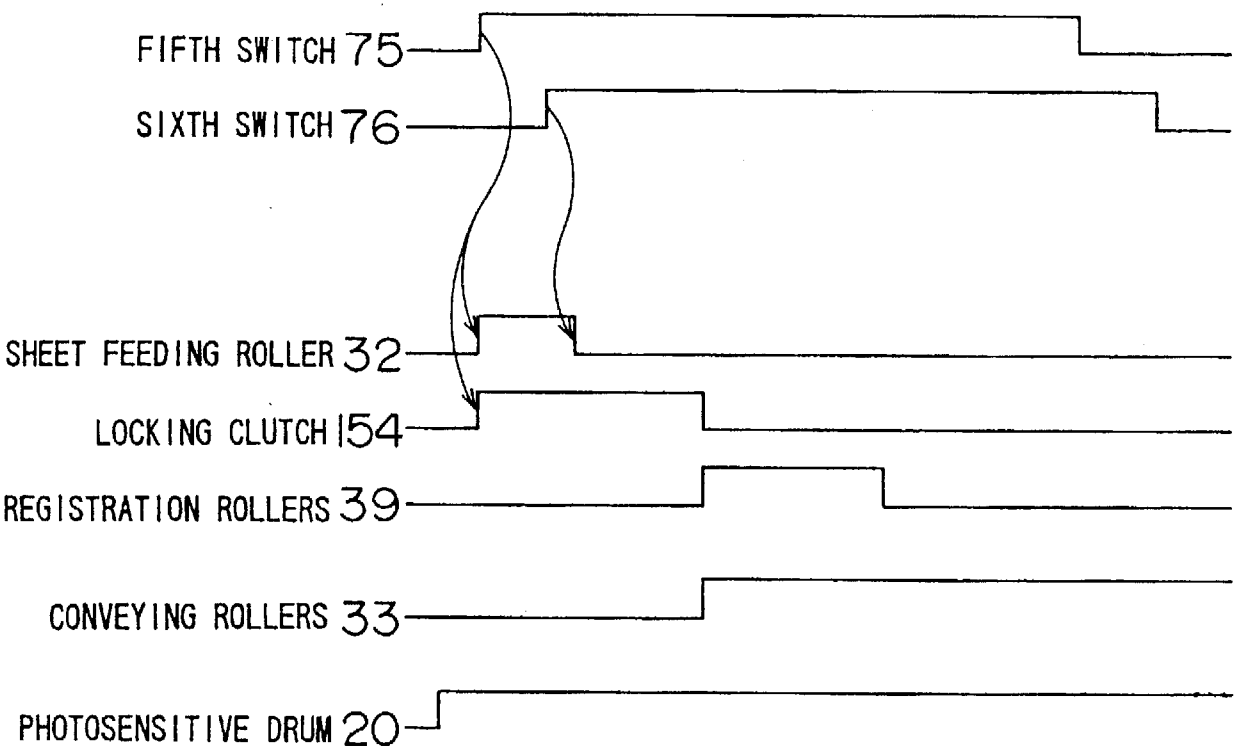
FIG. 6 is a timing chart showing operation timing of control of the conveyance by the control circuit in FIG. 5.

FIG. 5 is a block diagram showing the characteristic construction of a control circuit of the copying machine according to the present embodiment, and FIG. 6 is a timing chart showing the operation of the control circuit. The control circuit 220 is constituted by a microcomputer, which includes a CPU 220*a*, a RAM 220*b* and a ROM 220*c*, and operates in accordance with a predetermined program stored in the ROM 220*c*. Consequently, operations as shown in FIG. 6 are realized.

Referring now to FIGS. 1 and 5, signals from the fifth leading end detecting switch 75 provided just in front of the sheet feeding roller 32 and the sixth leading end detecting switch 76 provided just in front of the registration rollers 39 as viewed in the direction of conveyance of the cut sheet in the bypass conveying path D4 are fed to the control circuit 220. The control circuit 220 controls the main motor MM and the sheet feeding motor DM on the basis of the signals from the switches. The control circuit 220 further carries out on/off control of the locking clutch 154 provided in the locking device 150 shown in FIG. 4. Further, the control circuit 220 respectively controls a clutch 221 for transmitting/disconnecting torque in the main motor MM to/from the conveying rollers 33, and the above-mentioned clutch 222 for the registration rollers and clutch 223 for the sheet feeding rollers, to control rotation/stop of the conveying rollers 33, the registration rollers 39 and the sheet feeding roller 32. Although output signals of all the switches shown in FIG. 1 are inputted to the control circuit 220, illustration of parts of the switches is omitted in FIG. 5 in order to make the construction easy to understand.

Referring now to the timing chart shown in FIG. 6, description is made of the rotation of the photosensitive drum 20, the conveying rollers 33, the registration rollers 39 and the sheet feeding roller 32 which are controlled by the control circuit 220 shown in FIG. 5.

The main motor MM is first driven, whereby the rotation of the photosensitive drum 20 is started. In this state, it is assumed that a cut sheet is inserted from the manual sheet feeding section 30. Consequently, the fifth leading end detecting switch 75 is first turned on by the leading end of the cut sheet.

The control circuit 220 makes a control to rotate the sheet feeding motor DM in response to an on signal of the fifth leading end detecting switch 75, and turns the clutch 223 on, to rotate the sheet feeding roller 32. Consequently, the cut sheet inserted from the manual sheet feeding section 30 is accepted and is conveyed to the registration rollers 39.

The locking clutch 154 in the locking device 150 is turned on in response to the on signal of the fifth leading end detecting switch 75, whereby the registration rollers 39 enters a locked state where they cannot be rotated, as described with reference to FIG. 4.

Therefore, the leading end of the cut sheet accepted by the sheet feeding roller 32 turns the sixth leading end detecting switch 76 on, to reach the nip position of the registration rollers 39 and is stopped therein. In this case, even if the trailing end of the cut sheet remaining outside the manual sheet feeding section 30 is pressed by an operator, so that the cut sheet is pressed in the direction of conveyance in the bypass conveying path D4, the leading end of the cut sheet does not further enter the bypass conveying path D4 forward beyond the nip position of the registration rollers 39.

Particularly, even when the cut sheet is a so-called tough cut sheet, the registration rollers 39 are inhibited from being freely rotated, so that the registration rollers 39 cannot be rotated. Accordingly, the leading end of the cut sheet does not enter the bypass conveying path D4 forward beyond the nip position of the registration rollers 39.

An on signal of the sixth leading end detecting switch 76 is fed to the control circuit 220. In response to the on signal, the control circuit controls the clutch 223 to turn off after an elapse of predetermined time after the on signal has been fed, to stop the rotation of the sheet feeding roller 32. The sheet feeding roller 32 thus continues to rotate until the predetermined time has elapsed after the on signal of the sixth leading end detecting switch 76 has been fed, after which the clutch 223 is turned off, whereby the leading end of the accepted cut sheet reliably reaches the nip position of the registration rollers 39.

Thereafter, the clutch 222 is turned on at predetermined timing, and the locking clutch 154 in the locking device 150 is turned off, whereby the registration rollers 39 are rotated. The predetermined timing is a timing at which the leading end of an image formed on the photosensitive drum 20 and the leading end of the cut sheet conveyed by the registration rollers 39 are to meet at the position for transfer 20*b* shown in FIG. 1. In the present embodiment, the clutch 221 is turned on, so that the conveying rollers 33 simultaneously start to be rotated in synchronization with the start of the rotation of the registration rollers 39. The conveying rollers 33 are rollers for further conveying the cut sheet conveyed along the bypass conveying path D4 toward the photosensitive drum 20, as described above.

Time required for the leading end of the cut sheet conveyed along the bypass conveying path D4 to reach the conveying rollers 33 after the conveyance of the cut sheet is resumed by the registration rollers 39 can be determined based on the length of the path from the registration rollers 39 to the conveying rollers 33, and the speed of conveyance. Hence, in the present embodiment, at the timing when the leading end of the cut sheet conveyed reaches the conveying rollers 33, and the cut sheet starts to be conveyed by the conveying rollers 33, the clutch 222 is turned off, whereby the registration rollers 39 are brought into the freely rotatable state. That is, a driving force applied to the registration rollers 39 is disconnected. The reason for this is that if the conveyance of the cut sheet by the registration rollers 39 is continued even after the cut sheet starts to be conveyed by the conveying rollers 33, there are possibilities such as irregularity in conveyance of the cut sheet and the slant of the cut sheet by a subtle difference in rotation between the conveying rollers 33 and the registration rollers 39.

Thereafter, the trailing end of the cut sheet conveyed along the bypass conveying path D4 separates from the registration rollers 39. In this case, the registration rollers 39 are in the freely rotatable state. Even when the trailing end of the cut sheet separates from the registration rollers 39, therefore, the cut sheet is hardly vibrated.

In other words, even when,the trailing end of the cut sheet being conveyed by the conveying rollers 33 is passing through the registration rollers 39 and when the trailing end of the cut sheet separates from the registration rollers 39, a load applied to the conveying rollers 33 from the cut sheet being conveyed thereby is hardly changed. Consequently, an image transferred to the cut sheet is prevented from being shifted.

Although in the above-mentioned embodiment, the conveying rollers 33 are switched to a rotatable/stopped state by the clutch 221, the copying machine may be so constructed that the clutch 221 is omitted so that the conveying rollers 33 are always rotated as the main motor MM rotates.

Various changes are possible in addition to the above-mentioned construction. For example, the locking device 150 provided in the registration rollers 39 may be a locking device having another structure using no clutch such as the clutch 154.

Although in the above-mentioned embodiment, description has been made by taking a copying machine as an example, the present invention is applicable to other image forming apparatuses such as a printer. Further, the present invention is also applicable to an apparatus for forming an image by a process other than an electrophotographic process, for example, an ink-jet process or a thermal transfer process.

Although the present invention has been described and illustrated in detail, it is clearly understood that the description is by way of illustration and example only and is not to be taken by way of limitation, the spirit and scope of the present invention being limited only by the terms of the appended claims.

What is claimed is:

1. An image forming apparatus comprising:

image forming means for forming an image on a sheet;

a conveying path for leading a sheet to the image forming means;

a sheet feeding roller, arranged in the conveying path, for feeding a sheet toward the image forming means;

a registration roller, arranged in a position on a downstream side of the sheet feeding roller with respect to a direction of sheet conveyance in the conveying path, the registration roller stops the conveyance of the sheet until a time later when the registration roller is driven to rotate to resume the conveyance of the sheet;

a locking means for inhibiting the rotation of the registration roller when a leading end of the sheet is being conveyed to the registration roller by the sheet feeding roller and releasing the inhibition of the rotation of the registration roller in synchronization with the resumption of the conveyance of the sheet by the registration rollers;

a conveying roller arranged in a position on a downstream side of the registration roller with respect to the direction of sheet conveyance in the conveying path; and a registration roller controlling means for stopping the driving of the registration roller at a time point when the leading end of the sheet reaches the conveying roller, to bring the registration roller into a freely rotatable state.

2. An image forming apparatus according to claim 1, further comprising:

a manual sheet feeding port for manually feeding a cut sheet of predetermined size, the manual sheet feeding port is connected to the conveying path, the sheet feeding roller being provided in the vicinity of the manual sheet feeding port in the conveying path, the sheet feeding roller for feeding the cut sheet inserted from the manual sheet feeding port in the direction of sheet conveyance in the conveying path.

3. An image forming apparatus according to claim 1, wherein the locking means includes;

a first gear fixed to a core shaft of the registration roller, a second gear meshed with the first gear, a supporting shaft rotatably supporting the second gear and fixed to a main body frame of the image forming apparatus, and a clutch which can be switched between a fixed state where the second gear is fixed to the supporting shaft and a rotation allowable state where the rotation of the second gear around the supporting shaft is allowed.

4. A sheet conveying method in an image forming apparatus in which a sheet feeding roller and a registration roller are arranged along a conveying path for leading a sheet to image forming means, the method comprising the steps of:

conveying the sheet toward the registration roller with the sheet feeding roller, while rotation of the registration roller is inhibited by a locking means;

releasing the inhibition of the rotation of the registration roller by the locking means and beginning to drive the registration roller to rotate to resume the conveyance of the sheet at a predetermined timing after a leading end of the sheet has reached the registration roller; and stopping the driving of the registration roller to bring the registration roller into a freely rotatable state at a time point when the leading end of the sheet has reached a conveying roller arranged on a downstream side of the registration roller in a direction of sheet conveyance in the conveying path, whereby when a trailing end of the sheet leaves the registration roller, the trailing end does not vibrate.

5. An image forming apparatus comprising:

image forming means for forming an image on a sheet;

a conveying path for leading a sheet to the image forming means;

a sheet feeding roller, arranged in the conveying path, for feeding a sheet toward the image forming means;

a registration roller, arranged in a position on a downstream side of the sheet feeding roller with respect to a direction of sheet conveyance in the conveying path, the registration roller stopping the conveyance of the sheet until a time later when the registration roller is driven to rotate to resume the conveyance of the sheet;

a locking means for inhibiting the rotation of the registration roller when a leading end of the sheet is being conveyed to the registration roller by the sheet feeding roller and releasing the inhibition of the rotation of the registration roller in synchronization with the resumption of the conveyance of the sheet by the registration roller;

a conveying roller arranged in a position on a downstream side of the registration roller with respect to the direction of sheet conveyance in the conveying path; and a registration roller controlling means for stopping the driving of the registration roller at a time point when the leading end of the sheet reaches the conveying roller to bring the registration roller into a freely rotatable state, wherein when the registration roller is in its freely rotatable state, the sheet conveyed by the registration roller does not substantially change a load applied to the conveying roller as the conveying roller conveys the sheet to thereby prevent vibration of the sheet when a trailing end of the sheet leaves the registration roller.

6. An image forming apparatus according to claim 5, further comprising:

a manual sheet feeding port for manually feeding a cut sheet of predetermined size, the manual sheet feeding port being connected to the conveying path, the sheet feeding roller being provided in the vicinity of the manual sheet feeding port in the conveying path, the sheet feeding roller feeding the cut sheet inserted from the manual sheet feeding port in the direction of sheet conveyance in the conveying path.

7. An image forming apparatus according to claim 5, wherein the locking means includes:

a first gear fixed to a core shaft of the registration roller, a second gear meshed with the first gear, a supporting shaft rotatably supporting the second gear and fixed to a main body frame of the image forming apparatus, and a clutch which can be switched between a fixed state where the second gear is fixed to the supporting shaft and a rotation allowable state where the rotation of the second gear around the supporting shaft is allowed.

* * * * *